US005517692A

United States Patent [19]

Wunderlich-Kehm

[11] Patent Number: 5,517,692

[45] Date of Patent: May 21, 1996

[54] MANICURIST'S THUMB AND FINGER PROTECTORS

[76] Inventor: Joan Wunderlich-Kehm, 3168 Middle Creek Rd., Gilbertsville, Pa. 19525

[21] Appl. No.: 303,774

[22] Filed: Sep. 9, 1994

[51] Int. Cl.[6] ..... A45D 29/00

[52] U.S. Cl. ..... 2/21; 132/73

[58] Field of Search ..... 2/21, 163, 167; 132/73, 285, 319; 223/101

[56] References Cited

U.S. PATENT DOCUMENTS

| | | | |
|---|---|---|---|
| 1,306,442 | 6/1919 | Sansotta | 2/21 |
| 1,359,717 | 11/1920 | McCarthy | 2/21 X |
| 2,847,005 | 8/1958 | Bourne | 2/21 X |
| 4,194,736 | 3/1980 | Loafman | 2/21 X |
| 5,063,613 | 11/1991 | Brown | 2/21 |
| 5,095,897 | 3/1992 | Clark et al. | 2/21 X |

*Primary Examiner*—C. D. Crowder

*Assistant Examiner*—Shirra L. Jenkins

*Attorney, Agent, or Firm*—Eckert Seamans Cherin & Mellott

[57] ABSTRACT

A set of digit or thumb and finger protectors provides a manicurist with protection against chafing irritation or injury from repeated contact with a nail file, emery board or the like. The set includes a thumb protector and an index-finger protector for the hand opposite a hand that holds the file or other tool. The thumb protector covers the skin on the back and sides of the thumb but allows the thumb pad to remain exposed for tactile sensation, for example to assess the smoothness of a filed surface, without having to remove the thumb protector. The index-finger protector covers the skin and nail at the end of the index finger. The index finger protector hinges adjacent the knuckle and has a throat cut out to permit free flexion and extension of the index finger. These protectors guard against accidentally filing or rasping the skin by an errant stroke. An optional additional finger protector is applied to a finger on the hand which holds the nail file to guard against injury from prolonged handling of the abrasive file or other tool.

11 Claims, 3 Drawing Sheets

MANICURIST' S THUMB AND FINGER PROTECTORS

BACKGROUND OF THE INVENTION

1. Field of the Invention

The invention relates to thumb and finger protectors particularly adapted for a manicurist. The protectors protect against chafing and rubbing sores, and other kinds of skin injury and/or irritation that are caused by the handling of a nail tile and/or cuticle nipper in connection with manicurists' services.

2. Prior Art

Professional manicurists regularly provide nail manicures to clients, among other services. A manicure includes sculpting nails, or wrapping the nails in a gel and silk or linin wrap, or any other form of treatment or care for the nails. Manicuring, or sculpting, artificial nails normally includes a vigorous filing of the client's fingernails with one or more types of nail files or similar abrading tools. Manicurists are at risk of certain occupational injuries due to handling of such tools, in particular nail files, due to the manner in which the files are used in servicing the clients' nails.

For example, the nail tile is held in one hand to work the file in a back-and-forth tiling action. The tile-holding hand typically is also abraded due to handling of the file, and the manicurist may develop a soft skin condition which, after prolonged periods of filing, can result in chafing or rubbed skin sores, and like injuries and irritations. Certain nail files are made with a gritty or coarse abrasive resembling sandpaper. Due to the abrasive nature of the tool, calluses are not developed, and instead the skin of the fingers or thumb may be filed so thin as to bleed after only one day of filing.

The hand opposite the one holding the file or other tool is also subject to chafing and skin injury or irritation, particularly because the manicurist typically holds the client's hand or finger while filing. Injuries occur, for example, when the manicurist inadvertently passes the tool over his or her own hand or finger rather than the client's fingernail, or when the manicurist files his or her hand accidentally at the same time as filing the client's fingernail. In practice, such injuries tend to occur repeatedly at the same point on the manicurist's hands. There are several spots that are especially at risk of injury or irritation, namely surfaces at and adjacent the fingers holding the file, and adjacent the usual places where the client's fingernails are disposed in the opposite hand.

It would be advantageous to provide a set of protectors for a manicurist that cover and protect injury-prone spots. However, such protectors should not so bind or encase the manicurist's hands as to detract from dexterity or coordination. The protectors should comfortably and easily attach to the fingers and should be structured to be agreeable to the customer. Moreover, since the manicurist's job requires good tactile sensation, for example to judge the smoothness of a filed edge, such protectors should not unduly cover those portions of the hands that are not in need of protection.

SUMMARY OF THE INVENTION

It is an object of the invention to provide a set of digit or finger and thumb protectors to safeguard a manicurist's hands against chafing, rubbed sores, or other skin injuries or irritations that can be caused at particular spots on the manicurist's hands by prolonged handling of an abrading device such as a nail file.

It is another object of the invention that one protector of the above set comprise a thumb protector for wearing on the hand opposite the hand which holds the nail file, to cover and protect the thumb when used to at least partially support the client's finger.

It is a further object of the invention to shape and arrange such a thumb protector to leave the thumb pad exposed, whereby the manicurist may use the thumb pad to judge the smoothness of the client's fingernail, without removing the thumb protector, and thus determine whether more or how much more filing is needed.

Another protector of the set comprises an index-finger protector for the hand opposite the hand which holds the nail file, to cover and protect the finger tip and nail of the index finger, typically used together with the thumb to support the client's finger while filing. The index-finger protector can be shaped and arranged to permit free flexion and extension of the index finger while the protector is in place.

Another object of the invention is to provide an optional finger protector for the hand which holds the nail file, to cover and protect soft skin of a finger on the file-holding hand which is most at risk of chafing irritations.

These and other aspects and objects are provided according to the invention in a set of digit (finger and thumb) protectors structured particularly for a manicurist. The protectors preferably comprise a set of thumb and index-finger protectors for the hand opposite the hand that holds the nail file. The set optionally includes a finger protector for a finger on the hand that holds the file.

Each of the protectors is preferably made from a suitable sheetlike flexible material such as leather or the like. The thumb protector can include a ring portion carrying complementary patches of hook and pile fasteners for releasably encircling the thumb above the knuckle at a comfortable tightness, to fix the thumb protector in place. The thumb protector has a flange portion that is joined to and extends from the ring portion to cover the skin on the back and sides of the thumb and thereby protect against inadvertent filing during a manicure.

An inventive aspect of the thumb protector includes the shape and arrangement of the flange portion, which leaves the thumb pad exposed. This permits the manicurist to feel the nail being manicured, e.g., to judge the smoothness of an edge, without having to remove the thumb protector to do so.

The index-finger protector has a ring portion which likewise is closed by complementary patches of hook and pile fasteners, and releasably encircles the index finger on the same hand where the thumb protector is used. The index-finger protector advantageously is placed above the first knuckle of the index finger. The index-finger protector has a thimble portion shaped and sized to sheath the end of the index finger, and a hinge portion joining the thimble portion and ring portion together. The index-finger protector covers the skin and nail of the index finger to protect on against accidental filing injury or irritation.

The manicurist can support the client's finger using the protected thumb and forefinger. Injury to the manicurist's hand is prevented while filing in the area of the client's fingernail, even though the manicurist remains free to support and manipulate the client's finger in various ways.

According to another inventive aspect, a V-shaped throat can be defined opposite the hinge portion such that the protector defines a thimble shape for the distal phalange of the finger and a cuff that couples to the next proximal phalange, the thimble shape and the cuff being joined at the V-shaped throat to permit free flexion and extension of the index finger at the last joint, while the index-finger protector is worn on the index finger.

A finger protector optionally can be worn on the hand that holds the nail file. This finger protector can formed generally as a ring and is also closed using complementary patches of hook and pile fasteners for releasable attachment to a finger on the file-holding hand, preferably above the first knuckle. This protector covers the soft skin of the finger against which the nail file is pressed, usually a finger adjacent the middle finger, to protect against chafing and or other rubbing irritations or injuries.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
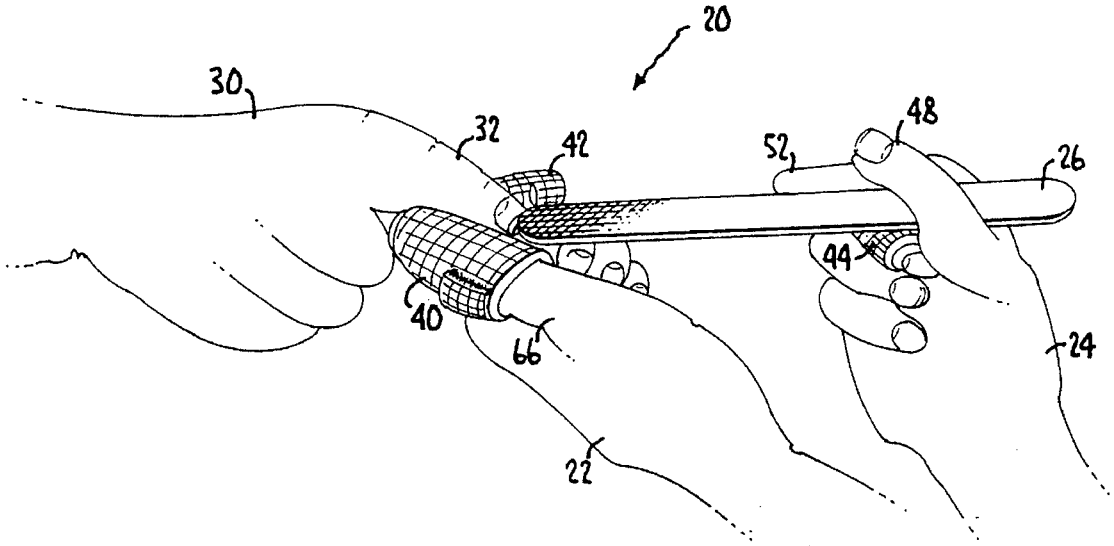
FIG. 1 is a perspective view of a manicurist's set of thumb and finger protectors according to the invention, wherein two hands of a manicurist and a hand of a client are shown, the manicurist wielding the file in one hand and supporting the client's finger in the other hand.
Figure 2:
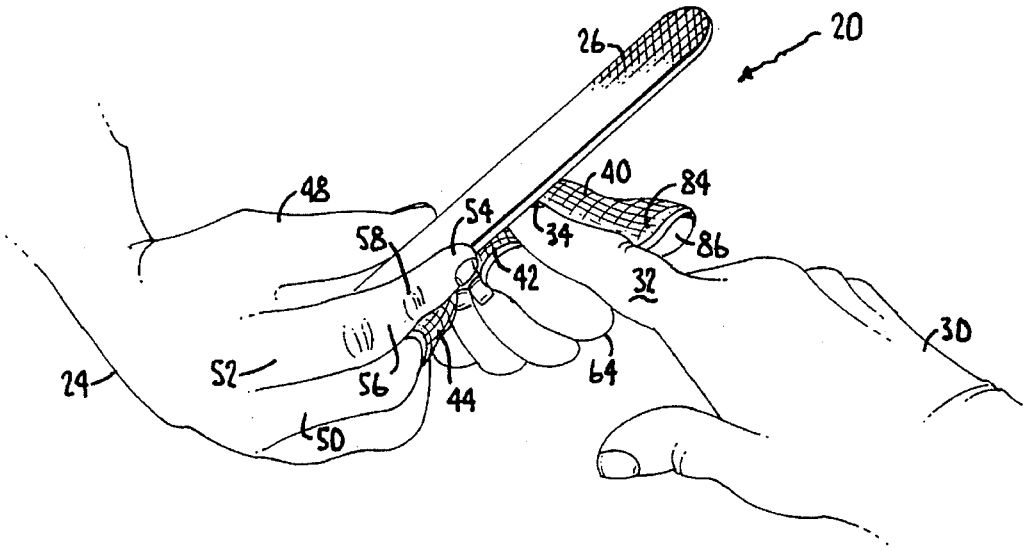
FIG. 2 is a perspective view corresponding to FIG. 1, except that the vantage point is shifted from that of the manicurist to that of the client, and additionally the manicurist has a slightly different grip on the nail file.

In FIGS. 1 and 2, a set of digit or thumb and finger protectors 20 according to the invention is worn on the hands 22 and 24 of a manicurist. The manicurist is holding a nail file 26 in one hand 24 and a hand 30 and/or finger 32 of the client in the other hand 22, while manicuring a fingernail 34 (FIG. 2) of the client. The protectors of the invention are particularly apt for use by professional manicurists who regularly provides manicure services to clients, and are at greatest risk of injury from repeated abrasions. However, protectors 20 according to the invention can be used by anyone who wishes to protect his or her hands from chafing or abrasions or other skin injuries and irritations that can occur while manicuring nails. Accordingly, terms like "manicurist" and "client" are used merely for convenience in this description and do not limit the invention to use by professionals only.

FIG. 1 shows one manner of gripping file 26, and FIG. 2 shows another manner of gripping the file. Other manners of gripping the file 26 are known, and the protectors of the invention can be worn accordingly. Moreover, a given manicurist may find it desirable to change the way the file is gripped from time to time. Nevertheless, the manner of gripping file 26 as shown in FIGS. 1 and 2 illustrates that there are typical points where file 26 will rub or chafe hand 24 which holds it, and/or hand 22 which supports the client's finger. The illustrated points of rubbing contact are typical of other manners of gripping the file 26.

Figure 3:
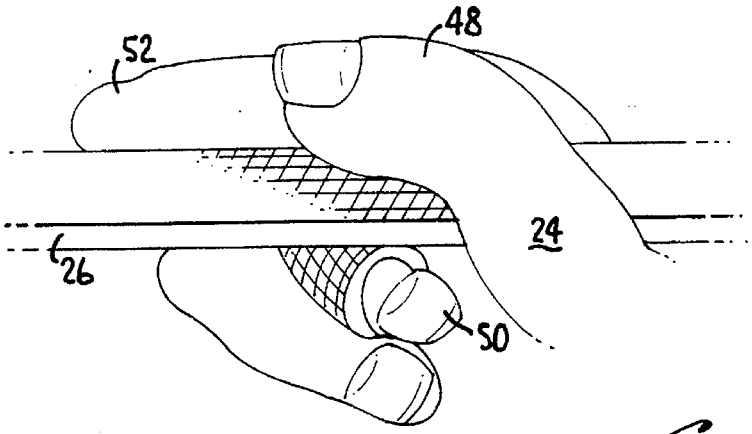
FIG. 3 is an enlarged perspective view of a phalange protector according to the invention as worn on a middle finger of the manicurist's file-holding hand, wherein the manicurist's grip on the nail file corresponds to the manner of gripping shown in FIG. 1.

An abrasive type of file, also known as an emery board, is shown in FIGS. 1–3. The illustrated nail file 26 is representative of a wide variety of nail files that are typically elongated and have opposite planar surfaces, at least one of which has an abrasive surface.

During a manicure, the manicurist files a client's fingernail 34 with back and forth strokes of the file 26 to give the fingernail 34 a desired edge shape, finish and/or degree of smoothness. The nail file 26 is sufficiently abrasive to abrade fingernail 34 effectively with repetitive back and forth strokes, and is manipulated for the required orientation relative to the finger. During manicure of a single fingernail, various nail files might be used with varying fineness in the grit, relatively coarser surface being used for removing material more quickly and finer surfaces being used for finishing. The various nail files are all sufficiently abrasive to chafe, rub or otherwise irritate the hands of the manicurist who manipulates them, particularly over a long time.

The digit or finger and thumb protectors 20 in accordance with the invention provide protection to the manicurist via thumb and index-finger protectors 40 and 42 for the fingers on hand 22 which are disposed adjacent the work area of the client's finger, and an optional protector 44 on the hand 24 which holds the file 26.

FIG. 3 is an enlarged detail of FIG. 1 which shows limited portions of the nail file 26 and the hand 24 which holds it. The nail file 26 has a lower planar surface (not in view) formed to be abrasive. The file 26 typically is gripped in hand 24 between thumb 48 and middle finger 50, with index finger 52 pressing against an edge of the file 26 for guidance. The middle and index fingers 50 and 52 are subdivided into phalanges or segments by knuckles. The file is advantageously rested against the side of the second last distal phalange 56, and perhaps partly against the knuckle or joint 58 at which the distal phalange 54 and next proximal phalange 56 are coupled, these phalanges being labelled in FIG. 2. Protector 44 is sized and shaped to be worn substantially on the middle phalange 56 of fingers 50 or 52, on hand 24 holding the file, preferably middle finger 50 as shown in FIG. 3.

Figure 4:
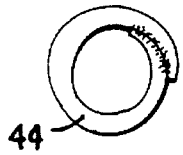
FIG. 4 is an end view of the phalange protector of FIG. 3, the hand and the file not being shown.
Figure 5:
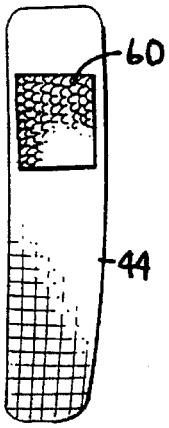
FIG. 5 is a top plan view of the phalange protector, unfastened and stretched flat.
Figure 6:
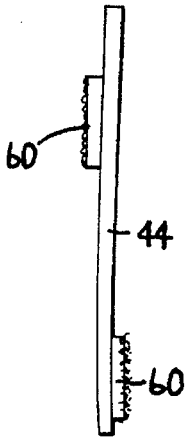
FIG. 6 is an edgewise from the right in FIG. 5.

FIGS. 4–6 show the middle-phalange protector 44 apart from the user's hands. Protector 44 comprises a flexible sheet-like strip of material such as leather or a like durable and flexible material. Middle-phalange protector 44 extends between opposite ends, and has opposite planar faces carrying complementary patches of hook and pile fasteners 60 (e.g., Velcro) adjacent opposite ends. In FIGS. 5 and 6, the middle-phalange protector 44 is opened flat and in FIG. 4, protector 44 is coiled in a loop or ring, as worn on phalange 56 of finger 50 or 52. The complementary patches of hook and pile material 60 are placed to overlap and engage over a range of distance for releasable fastening of the protector 44 with some adjustability in circumference to accommodate different size fingers.

Protector 44 covers areas on the finger (e.g., the middle finger as shown) that are likely to be rubbed sore from filing. A vulnerable spot on the finger is the lateral side of finger 50 opposed by index finger 52 and/or thumb 48. Thumb 48 and index finger 52 also touch the file; however, the thumb and index finger contact the file on their pad surfaces (i.e., the surfaces having friction ridges, extending only halfway around the finger and typically brought into contact with grasped items). The skin on the pad surfaces is thicker and tougher than the skin on the sides of the fingers, and is less prone to abrasive injury. Moreover, in a manual activity such as filing, it is helpful to have good tactile feedback from the pad surfaces, especially of the index finger, for good dexterity.

The middle-phalange protector 44 protects the vulnerable side of the middle finger 50 against which the file 26 is typically held. In FIG. 2, the file 26 is gripped in a slightly different manner than in FIGS. 1 and 3, but the file 26 is still held against the vulnerable side surface of middle finger 50, being protected in this area according to the invention without detracting from the manicurist's tactile sensation or dexterity.

Opposite hand 22 of the manicurist risks injury or irritation from the nail file 26 by inadvertent application of the file against surfaces of the manicurist's fingers, used to support the client's finger while filing nail 34. Hand 22 typically holds and stabilizes the client's finger 32 and nail 34 in place by grasping the client's finger 32 between the index finger 64 and thumb 66. Not infrequently, the end of the file is inadvertently moved against a supporting finger, or the edge or flat of the file contacts a supporting finger as the manicurist maneuvers the file and the client's finger relative to one another while following along an edge to be filed.

A human thumb has two phalanges connected by a knuckle 68 (see FIG. 7), one being an endmost or distal phalange 70 and the other an intermediate or proximal phalange 72. The skin that is most vulnerable on the thumb is the skin on the knuckle 68, and on the back side of the two phalanges 70 and 72. The front side opposing the index finger 64 is also subject to injury, and although the front side has the pad surface, even the pad surface is vulnerable due to direct association with the filing operation on the supported finger. The index finger 64 (see FIGS. 1 and 2) is at risk, primarily at end knuckle 58 (see FIG. 2) and end and middle phalanges (e.g., 54 and 56).

Thumb protector 40 and index-finger protector 42 according to the invention provide protection to the skin on these areas of hand 22, permitting the manicurist to proceed with the operation without substantial attention to avoiding contact with the supporting hand 22.

Figure 7:
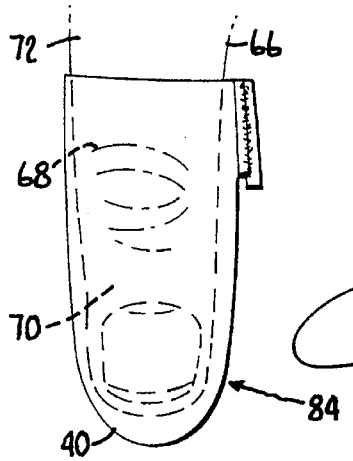
FIG. 7 is top plan view of a thumb protector according to the invention as worn on a thumb of the manicurist's client-holding hand.
Figure 8:
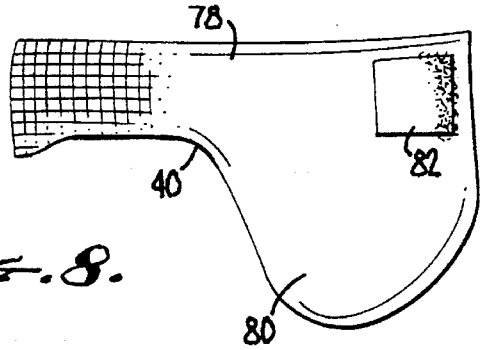
FIG. 8 is a top plan view of the thumb protector of FIG. 7, unfastened and stretched flat.
Figure 9:
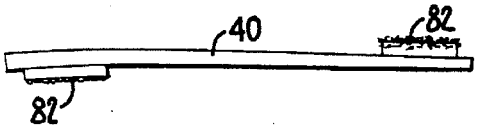
FIG. 9 is an edgewise view from below in FIG. 8.
Figure 10:
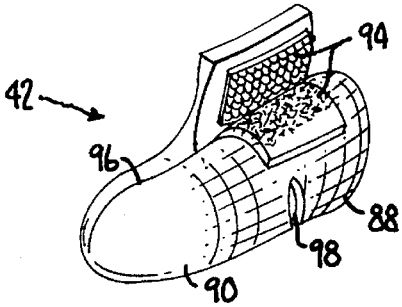
FIG. 10 is a perspective view of a finger tip protector according to invention, shown partly unfastened.
Figure 11:
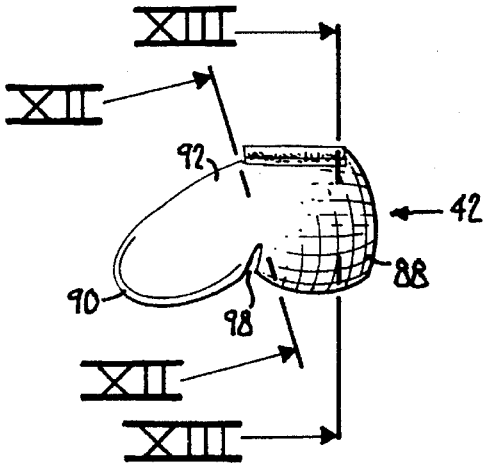
FIG. 11 is a side elevation view corresponding to FIG. 10, shown fastened.

With reference to FIGS. 7–9, thumb protector 40 comprises a flexible sheet material such as leather or a like durable and flexible material. Thumb protector 40 has opposite planar faces and, when opened flat as in FIG. 8, defines a P-shape in plan. In FIG. 7, thumb protector 40 is wound as worn on thumb 66.

As shown in FIG. 8, the thumb protector 40 has a ring portion 78 and a flange portion 80. Ring portion 78 extends between opposite edges along a left to right line in the drawing, the left and right ends being overlapped to close the protector 40 into a ring. Of course, any of the protectors can be oriented in various orientations, and accordingly, terms like "left" and "right"; "forward", "outward" and "inner" and the like are used merely for convenience in referring to the drawings and do not limit the invention. Ring portion 78 is dimension to encircle intermediate phalange 72 of thumb 66 to secure the thumb protector 40 in place on the thumb 66. The opposite ends of ring portion 78 carry complementary patches of hook and pile fasteners 82 on opposite faces of thumb protector 40. The opposite patches of hook and pile fasteners 82 releasably fasten ring portion 78, and provide a span of adjustability for different size thumbs.

Flange portion 80 is joined to and extends forwardly on the thumb (down in FIG. 7) from ring portion 78 to cover the back of the thumb and one side of knuckle 68 at end and intermediate phalanges 70 and 72 of thumb 66. In FIG. 7, a particular lateral side of the thumb protector is indicated by reference arrow 84 (see also FIG. 2), which side opposes index finger 64 of hand 22. This can be considered the inner side 84 of the thumb 66, as distinguished from outer side, directed away from the index finger. FIGS. 1 and 2 show that this inner side 84 of thumb 66 is the side exposed to accidental filing, and according to the invention this vulnerable side is protected without interfering with the tactile sensations and dexterity of the manicurist.

Thumb protector 40 is shaped and arranged to cover the back and the inner side 84 of the knuckle 68 and end and intermediate phalanges 70 and 72 of thumb 66. An inventive aspect of thumb protector 40 is the flange portion 80, because it leaves exposed the pad 86 (see FIG. 2) of the thumb 66. The manicurist can rub exposed thumb pad 86 over the fingernail 34, to judge the smoothness of the edge, without having to remove thumb protector 40.

FIGS. 10–13 show a partly tubular index-finger protector 42, which is also made from a flexible sheet material such as leather or the like, and has mating hook and pile fasteners. Index-finger protector 42 comprises a ring portion 88 for encircling a middle phalange (e.g., phalange 56 in FIG. 2) of index finger 64, a thimble or cup-shaped portion 90, and a hinge portion 92 interconnecting thimble portion 90 and ring portion 88.

Figure 12:
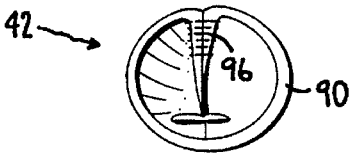
FIG. 12 is a section view taken along line XII—XII in FIG. 11.
Figure 13:
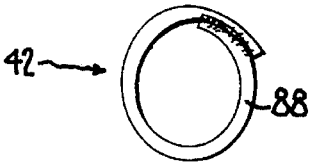
FIG. 13 is a section view taken along line XIII—XIII in FIG. 11.

Thimble portion 90 is formed into a thimble or cup shape complementary with the end of the user's finger. This is accomplished by a sewn seam 96. Preferably the threads of seam 96 are internal as shown in FIG. 12, so that they cannot be filed away accidentally. Thimble portion 90 sheathes the end phalange (e.g., 54 in FIG. 2) of index finger 64. Thimble portion 90 can flex or hinge at area 92, preferably located on the back of the end knuckle (e.g., 58 in FIG. 2). However, in this area the material of protector 42 is continuous, which limits flexing (particularly if the material is relatively thick). The ring and thimble portions 88 and 90 also define an inverted-V shaped throat 98 opposite the hinge portion 92, where protector 42 is discontinuous, to permit free flexion of the index finger 64 between the distal and next proximal phalanges. Indexfinger protector 42 substantially covers the back and sides of the end knuckle (e.g., 58 in FIG. 2) and the two distal phalanges (e.g., 54 and 56 in FIG. 2) of index finger 64, as well as the finger tip, fingernail and associated finger pads.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A set of digit protectors for a hand of a manicurist, comprising:

a thumb protector that includes a ring portion for encircling a phalange of a thumb to secure the thumb protector on the thumb, and a flange portion joined to and extending from the ring portion such that the flange and ring portions substantially cover a back and inner lateral side of an end phalange and knuckle of the thumb; and, a partly tubular index-finger protector including a ring portion for encircling a middle phalange of an index finger to secure the finger protector in place, a thimble portion shaped and sized to sheath substantially an end phalange of the index finger, and a hinge portion interconnecting the associated ring portion with the thimble portion, wherein the hinge portion and the associated ring portion are shaped to cover a back and sides of an end knuckle and the middle phalange of the index finger;

wherein the flange portion is shaped to expose a thumb pad of the thumb, whereby the thumb pad is available for tactile sensation while the thumb protector is secured on the thumb; and, wherein the partly tubular index-finger protector defines a V-shaped throat opening located at a same axial location relative an axis of the partly tubular index-finger protector as the hinge portion, whereby flexion of an index finger at the throat is permitted while the index-finger protector is secured on the index finger.

2. The set of digit protectors of claim 1, wherein each of the protectors is made from a flexible sheet material.

3. The set of digit protectors of claim 2, wherein the sheet material comprises leather.

4. The set of digit protectors of claim 1, wherein the thimble portion includes a sewn seam with threads disposed internally in the thimble portion.

5. The set of digit protectors of claim 1, wherein the ring portions of at least one of the thumb protector and the finger protector comprise hook and pile fasteners for closing the ring portions at a desired circumference.

6. A set of digit protectors for a manicurist, comprising:

a thumb protector having a ring portion with means for releasably encircling an intermediate phalange of a thumb to secure the thumb protector in place, and a flange portion joined to and extending from the ring portion to cover a back and inner lateral side of an end phalange and knuckle of the thumb;

a partly tubular index-finger protector having a ring portion with means for releasably encircling a middle phalange of an index finger on a same hand as said thumb, to secure the finger protector in place, a thimble portion shaped and sized to sheath an end phalange of the index finger, and a hinge portion interconnecting the thimble portion with the associated ring portion, wherein the hinge portion and associated ring portion are shaped to cover substantially the back and sides of an end knuckle and the middle phalange of the index finger; and a middle-phalange protector that includes means for releasably encircling a middle phalange of a finger on the other hand of the manicurist to thereby secure the middle-phalange protector in place during use, which middle-phalange protector is shaped to cover substantially one lateral side of said middle phalange of the finger on said other hand;

wherein the flange portion is shaped and arranged to expose a thumb pad of a thumb on which the thumb pad protector is secured, to thereby permit the manicurist to feel a surface with the thumb pad while the thumb protector is secured in place on the thumb; and, wherein the partly tubular index-finger protector defines a V-shaped throat opening located at a same axial location relative an axis of the partly tubular index-finger protector as the hinge portion to permit flexion of an index finger while the index-finger protector is secured on the index finger.

7. The set of digit protectors of claim 8, wherein each of the protectors is made from a flexible sheet material.

8. The set of digit protectors of claim 7, wherein the sheet material comprises leather.

9. The set of digit protectors of claim 8, wherein the thimble portion is partly formed by a sewn seam with threads internal to the thimble portion.

10. The set of digit protectors of claim 6, wherein each of the means for releasably encircling an intermediate phalange of a thumb, the means for releasably encircling a middle phalange of an index finger on the same hand as the thumb, and the means for releasably encircling a middle phalange of a finger on the other hand of the manicurist as the thumb, comprises patches of hook and pile fasteners.

11. The set of digit protectors of claim 6, wherein the middle-phalange protector is sized and shaped for encircling a middle finger.

* * * * *